US006397412B1

(12) United States Patent
Quintile

(10) Patent No.: US 6,397,412 B1
(45) Date of Patent: Jun. 4, 2002

(54) BED FRAME STRUCTURES WITH UNIBODY UNIVERSAL CASTER MOUNTS, INTERLOCKING RAIL MEMBERS AND FLUSH RAIL SUPPORT SURFACES

(75) Inventor: Mark J. Quintile, Brunswick, OH (US)

(73) Assignee: Anchor Tool & Die Corp., Cleveland, OH (US)

( * ) Notice: Subject to any disclaimer, the term of this patent is extended or adjusted under 35 U.S.C. 154(b) by 0 days.

(21) Appl. No.: 09/456,227

(22) Filed: Dec. 7, 1999

(51) Int. Cl.[7] ..... A47C 19/02

(52) U.S. Cl. ..... 5/200.1; 5/310; 5/285; 5/286

(58) Field of Search ..... 5/200.1, 310, 201, 5/203, 206, 207, 282.1, 285, 286; 16/30, 43

(56) References Cited

U.S. PATENT DOCUMENTS

| | | | | | |
|---|---|---|---|---|---|
| 2,772,424 | A | * | 12/1956 | Roche et al. | 5/200.1 X |
| 2,857,602 | A | * | 10/1958 | Quintana | 5/286 |
| 2,911,656 | A | * | 11/1959 | Roche et al. | 5/310 |
| 3,100,304 | A | * | 8/1963 | Brandlin et al. | 5/310 |
| 3,123,837 | A | | 3/1964 | Paine et al. | 5/181 |
| 3,230,555 | A | * | 1/1966 | Hooker | 5/285 |
| 3,537,114 | A | | 11/1970 | Mis | 5/201 |
| 3,646,623 | A | | 3/1972 | Harris et al. | 5/181 |
| 3,680,158 | A | | 8/1972 | Speed | 5/319 |
| 3,683,429 | A | | 8/1972 | Mis | 5/201 |
| 3,754,289 | A | | 8/1973 | Larkin | 5/200 |
| 3,761,971 | A | | 10/1973 | Behnke | 5/201 |
| 3,781,930 | A | | 1/1974 | Spitz | 5/201 |
| 3,795,022 | A | | 3/1974 | Harris | 5/181 |
| 3,828,376 | A | * | 8/1974 | Miller | 5/200.1 |
| 3,952,345 | A | | 4/1976 | Spitz | 5/207 |
| 3,961,384 | A | | 6/1976 | Spitz | 5/184 |
| 3,982,291 | A | | 9/1976 | Damico | 5/294 |
| 3,995,334 | A | | 12/1976 | Harris | 5/202 |
| 4,007,502 | A | * | 2/1977 | Mis | 5/200.1 X |
| 4,027,343 | A | | 6/1977 | Hooker | 5/200 |
| 4,038,710 | A | | 8/1977 | Tambascio | 5/200 |
| 4,070,717 | A | | 1/1978 | Kitchen et al. | 5/176 |
| 4,078,270 | A | | 3/1978 | Nowell | 5/181 |
| 4,078,271 | A | * | 3/1978 | Tambascio | 5/310 |
| 4,103,374 | A | * | 8/1978 | Knoke | 5/310 X |
| 4,155,131 | A | | 5/1979 | Harris et al. | 5/296 |
| 4,169,294 | A | | 10/1979 | Harris | 5/200 |
| 4,218,789 | A | * | 8/1980 | Grassi | 5/310 X |
| 4,224,704 | A | | 9/1980 | Nowell | 5/181 |
| 4,263,683 | A | | 4/1981 | Knoke | 5/200 |
| 4,276,665 | A | | 7/1981 | Mis | 5/184 |
| 4,281,424 | A | | 8/1981 | Singer et al. | 5/282 |
| 4,329,746 | A | | 5/1982 | Bergerud | 5/164 |
| RE31,384 | E | | 9/1983 | Mis | 5/202 |
| 4,430,763 | A | | 2/1984 | Whitehead | 5/200 |
| 4,458,371 | A | * | 7/1984 | Whitehead | 5/200.1 |
| 4,536,904 | A | | 8/1985 | Whitehead | 5/201 |
| 4,627,120 | A | * | 12/1986 | Harris | 5/310 X |
| 4,646,371 | A | | 3/1987 | Nowell | 5/200 |

(List continued on next page.)

*Primary Examiner*—Lynne H. Browne
*Assistant Examiner*—Robert G. Santos
(74) *Attorney, Agent, or Firm*—Arter & Hadden LLP

(57) ABSTRACT

A bed frame constructed by assembly of rail members with universal caster mounts at points of intersection of the rails, where ends of the rail members are integrally connected to the universal caster mounts without any bracketry or parts attached to the ends of the rail members. The universal caster mounts have a top wall for connection to a rail member, a side wall, and a caster shank receiving ferrule. A slot in the top wall receives a portion of an end of a rail member for direct connection of the rail member to the caster mount. A portion of the end of the rail member engaged in the slot rests upon the top wall, flush with the portion of another rail member attached to the top wall, to provide a truly flush support surface for a mattress box spring. Different frame designs, and a low profile caster mount are also disclosed.

22 Claims, 7 Drawing Sheets

U.S. PATENT DOCUMENTS

| | | | | | |
|---|---|---|---|---|---|
| 4,745,644 | A | | 5/1988 | Pottschmidt | 5/200 |
| 4,827,543 | A | * | 5/1989 | Castiglioni et al. | 5/200.1 X |
| 4,870,711 | A | | 10/1989 | Felix | 5/200 |
| 5,012,538 | A | | 5/1991 | Timm | 5/200 |
| 5,161,268 | A | | 11/1992 | Harrow | 5/201 |
| 5,231,713 | A | * | 8/1993 | McDonnell | 5/200.1 X |
| 5,243,720 | A | | 9/1993 | Harrow | 5/201 |
| 5,477,571 | A | * | 12/1995 | Roggenkomp et al. | 5/310 |
| 5,564,140 | A | | 10/1996 | Shoenhair et al. | 5/400 |
| 5,740,568 | A | | 4/1998 | Elliott | 5/620 |
| 5,894,614 | A | | 4/1999 | Stroud | 5/200 |

* cited by examiner

BED FRAME STRUCTURES WITH UNIBODY UNIVERSAL CASTER MOUNTS, INTERLOCKING RAIL MEMBERS AND FLUSH RAIL SUPPORT SURFACES

FIELD OF THE INVENTION

The present invention pertains generally to frame structures and, more particularly, to elevated frame structures with interconnected linear members, and which can be assembled by a home owner or end user without the use of fasteners.

BACKGROUND OF THE INVENTION

Bed frames are used to support a box spring and mattress several inches off the floor, and are commonly mounted upon casters at the four corners and intermediate points of the frame. Typically the bed frame consists of a plurality of generally L-shaped side and cross frame members detachably secured to one another for supporting the mattress and box spring unit between a foot board and head board. In the industry, the frame members are made from recycled railroad rail steel which is heated, re-shaped and processed into the L-shaped configuration. This recycled steel has very high carbon content and high strength as compared to conventional structural component materials. In the prior art, the generally orthogonal frame members are connected at the intersections by brackets which are attached to the ends of the frame members. For example, U.S. Pat. No. 3,683,429 describes a bed frame wherein several bracket pieces are attached to both of the intersecting frame members. Frames are supported by casters held by caster mounting brackets which are attached to the frame members. The casters are held by brackets which are attached to the frame members. The steel from which such brackets are made is of significantly lower strength than that of the frame members. Thus, the strength of the frame members is not utilized at the intersections, where high load and moment forces occur. Also, the brackets represent a number of parts which must be fabricated and separately attached to the frame members. Some frame designs which include a center rail within a rectangular frame require as many as 22 or more bracket pieces and 44 to 48 or more fasteners such as rivets.

In some prior art bed frames, the box spring supporting surfaces of the intersecting frame members are not flush, i.e., not in the same plane. This occurs as a result of the complex bracket assemblies used to form the intersections, particularly those which rely on a tapered wedge type connection. Consequently, the wooden frame of a box spring and the mattress will warp and sag when placed on such frames, especially in the center. A bed frame which utilizes the substantial strength of the frame members as an integral component of the frame intersections, which eliminates many bracket pieces, and which provides a truly flush support surface is not provided by the prior art.

SUMMARY OF THE INVENTION

The present invention overcomes these and other disadvantages of the prior art. The bed frame structures utilize the terminal ends of the rail members as integral structural connections to universal unibody caster mounts at the intersections of the rail members. Slots in the caster mounts are configured to accept a portion of a rail member to precisely align the horizontal flanges of the intersecting rails to provide a truly flush support surface for a mattress box spring. No bracketry is required at the ends of the rail members for connection to the caster mounts. The caster mounts are of a universal configuration at each rail intersection. The rail-accepting slots in the caster mounts are configured to accept and frictionally bind one or two rail flanges. The caster mount rail-accepting slots can be formed by displacement of material from an adjacent wall of the caster mount, thus creating a double wall thickness which supports an interlocking notch in the rail.

In accordance with one general aspect of the invention, there is provided a bed frame structure which includes rail members interconnected to form a generally orthogonal frame structure, each rail member having at least one flange oriented in a horizontal plane, the rail members including laterally opposed and spaced apart side rails, and opposed spaced apart transverse rails which extend generally perpendicularly between the side rails, with ends of the transverse rails positioned proximate to the side rails, a caster mount located at each end of the transverse rails, each caster mount having a main body, a top wall, a side wall, and a caster shank receiving ferrule, the top wall of each caster mount fastened to a side rail proximate to the ends of the transverse rails, and a rail receiving slot in the caster mount, wherein the rail receiving slot in the caster mount is in the top wall of the caster mount, and extends generally to a point of intersection of the top wall and the side wall and ends of the transverse rails having a notch and an end section proximate to the notch, the end section adapted to fit in the slot in the caster mount, and the notch adapted to fit over the side wall of the caster mount.

In accordance with another general aspect of the invention, there is provided a bed frame caster mount for connection of at least two rails of a bed frame and a caster, the caster mount having a body with a generally horizontal top wall dimensioned for attachment to a first rail of a bed frame, a side wall connected to and extending generally downward from the top wall, and a caster shank receiving ferrule connected to or extending from the side wall, a slot formed in the top wall and adapted to receive a portion of a second rail of a bed frame, the portion of the second rail received in the slot extending through the top wall and located proximate to the side wall, and another portion of the second rail positioned on top of the top wall and substantially flush with the portion of the first rail on the top wall of the caster mount.

These and other aspects of the invention are herein described in detail with reference to the accompanying Figures.

DETAILED DESCRIPTION OF PREFERRED AND ALTERNATE EMBODIMENTS

Figure 1:
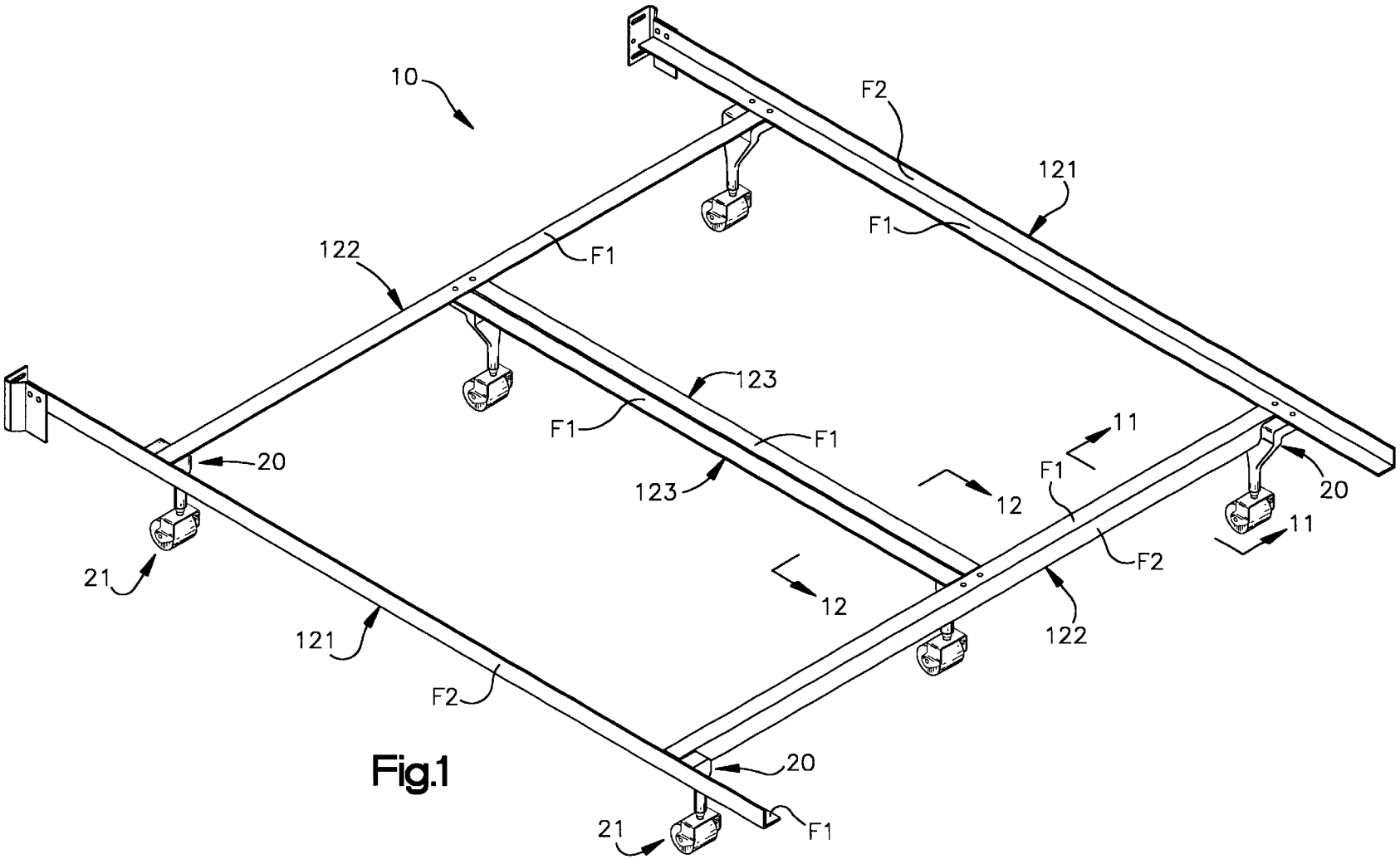
FIG. 1 is a perspective view of a bed frame structure of the present invention.

With initial reference to FIG. 1, there is shown a bed frame, indicated generally at 10, formed by a generally orthogonal arrangement of intersecting rails, including side rails 121, transverse rails 122, and center or intermediate rails 123. The rails are supported at the various intersections by casters 21, each connected to caster mounts 20. Each of the rails are generally L-shape in cross-section, each having a first flange F1 and a second flange F2. Within the frame 10, the rails can be selectively arranged so that the adjoining right angle flange F1 or F2 is oriented to extend up or down, with the other flange in a horizontal plane. As described herein, the flanges F1 are oriented in a generally horizontal plane, and flanges F2 are generally vertically oriented. Although the frame 10 is described in connection with L-shape cross-section type rails, it is understood that other types or designs of rails could be employed in connection with the principles of the invention, such as the described T-shape rail, or a U-shape rail cross-section with flanges of the rail oriented downward and fitting within two slots in the universal caster mount. In a preferred embodiment, the L-shape cross-section type rails are made from recycled railroad rails, such as manufactured by the Jersey Shore Steel Company.

As further shown in FIGS. 2–9, the rails 121–123 are interconnected at each of the intersections by a universal unibody caster mount 20, to which a universal caster 21 is attached. The caster mount 20 includes a main body section 22, a caster shank receiving ferrule 25, a side wall 26, and a top wall 28. Flanges 29 extend generally perpendicularly from the lateral edges of the top wall 28 and side wall 26, providing rigidity to the caster mount body 22. The caster shank receiving ferrule 25 is formed by lower sections of flanges 29 roll-formed together in a cylindrical form so that the edges 291 of the opposing flanges are abutting. The caster mount 20 is thus of unibody or one piece construction, formed from a single piece of steel, such as HSLA (high strength low alloy) or HRS (hot rolled steel) type steels.

Figure 17:
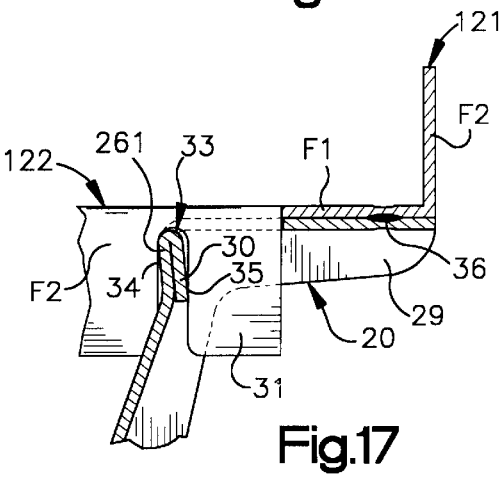
FIG. 17 is an elevation of a portion of a caster mount of the invention.

The angle A between the side wall 26 and top wall 28 may be formed in a selected range from approximately 90 degrees to greater than 90 degrees, depending upon certain design parameters, as further discussed herein. The side wall 26 may be configured to have an upper section 261 (which may be generally perpendicular to top wall 28 or angled away from or under the top wall 28) and a lower section 262 which is also angled relative to upper section 261 and to top wall 28. Angle B, between sections 261 and 262 of side wall 26, can be selectively designed to position the caster shank receiving ferrule 25 (and consequently caster 21) relative to slot 32, upper wall section 261, and top wall 28. In one alternate embodiment, as shown in FIG. 17, upper wall section 261 is slightly reverse angled underneath top wall 28. This arrangement also creates a moment force which acts at the tab 30 in contact with end piece 31 of rail 122.

Figure 7:
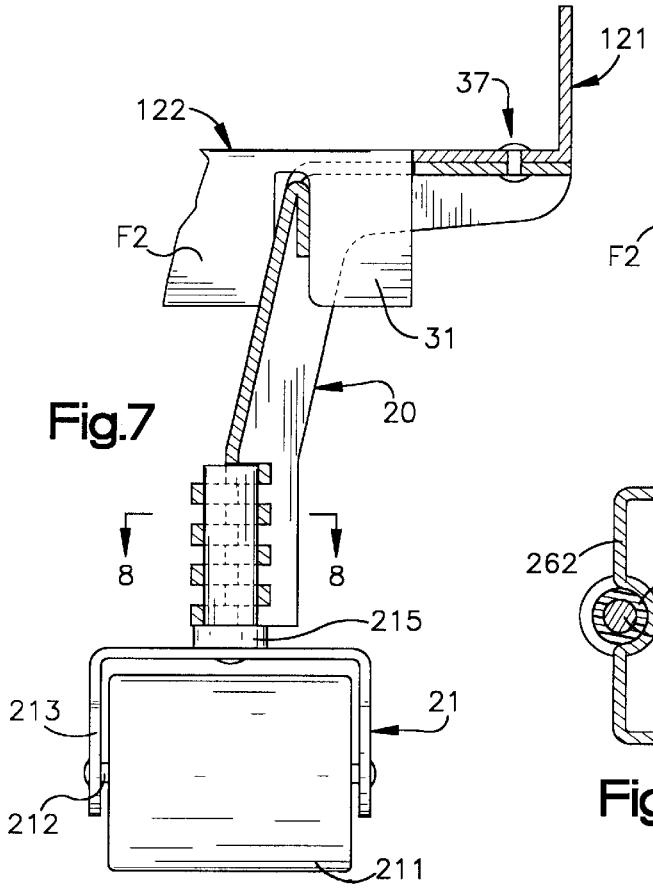
FIG. 7 is a cross-sectional elevation of a caster mount and rail intersection area of a bed frame of the invention.
Figure 8:
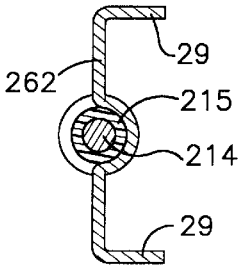
FIG. 8 is a cross-sectional view of a caster shank receiving portion of a caster mount of the invention, in the direction of the arrows 8—8 in FIG. 7.

The caster shank receiving ferrule 25 is preferably formed by a roll-form operation on the lower portion of the caster mount body. Alternatively, as shown in FIGS. 7 and 8, a lower cylindrical portion of the caster mount body can be lanced to form a slotted cylinder to receive a caster shank. The caster 21, such as the type manufactured by the Haydock Caster Company, has a wheel 211 mounted upon an axle 212 supported to rotate within a fork or wheel mount 213. The fork 213 is swivel attached to the caster shank 214. A bushing 215 may be provided about the shank 214, and the ferrule 25 dimensioned to receive the bushing 215. Alternatively, glides or static support structures (as shown for example at 211 in FIG. 18B) can be used in place of casters, with similar shank structures engaged with the caster mounts 20.

As shown specifically in FIGS. 2, 3, 4, 5 and 6, cut from the top wall 28 is a tab 30 which is bent downward to a position generally perpendicular to top wall 28 and generally parallel to side wall 26, forming a slot 32 in top wall 28, and a double wall thickness at the area of the side wall aligned with slot 32. The slot 32 has a linear extent which traverses a portion of the top wall 28, and a width dimensioned to accept the cross-sectional thickness of one or two flanges F1 or F2 of the rails. A notch 33 is formed in flange F2 of transverse rails 122, dimensioned to fit over side wall 26 and tab 30 (and more specifically to fit over upper section 261 of side wall 26), with the remaining portion of flange F2 in the form of a leg 31 positioned under top wall 28 of the caster mount 20. The notch 33 has a side wall contact edge 34 which is preferably cut or tapered to match the angle B of the side wall 26 relative to top wall 28 of the caster mount 20. This provides a positive load-bearing contact between the rail and the caster mount. An opposite edge 35 of notch 33 bears against tab 30 which may be sprung slightly against edge 35 to create a frictional locking force on edge 35 to keep the rail securely engaged within slot 32 of the caster mount. The transverse rail 122 is thus an integral structural member of the intersection. The superior strength of the hardened steel of the rail is taken advantage of by engaging the rail directly with the caster mount 20, without any additional bracketry attached to the rail.

Figures 2, 3, 4:
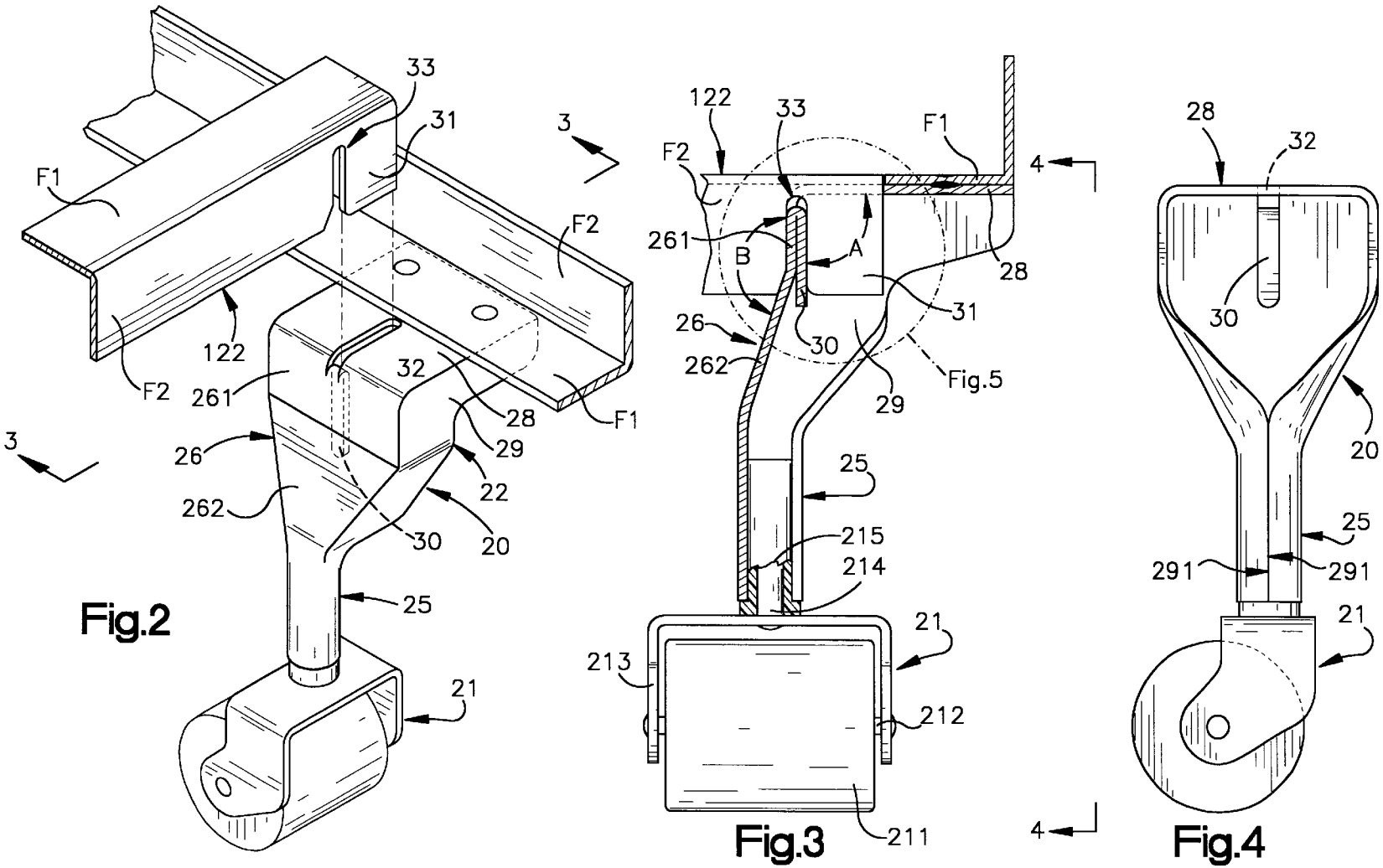
FIG. 2 is a perspective view of an intersection area of a bed frame structure of the present invention.
FIG. 3 is an elevation of a universal caster mount and an intersection area of the bed frame structure of the present invention, taken in the direction of the arrows 3—3 in FIG. 2.
FIG. 4 is an elevation of a universal caster mount of the present invention.
Figure 5:
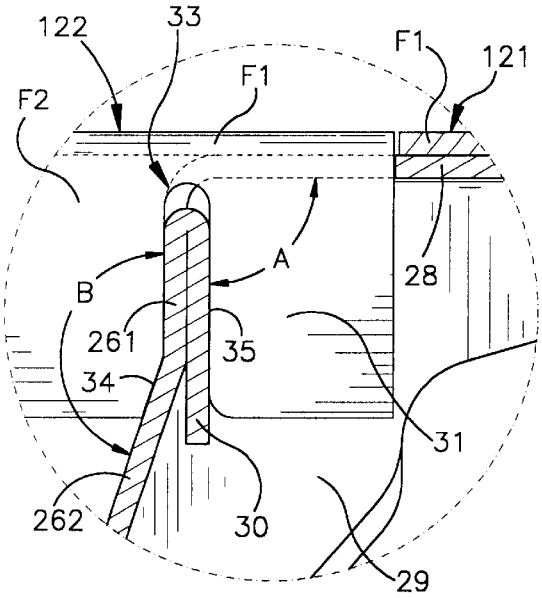
FIG. 5 is an elevation of an intersection portion of an alternate embodiment of a bed frame structure of the present invention.
Figure 10:
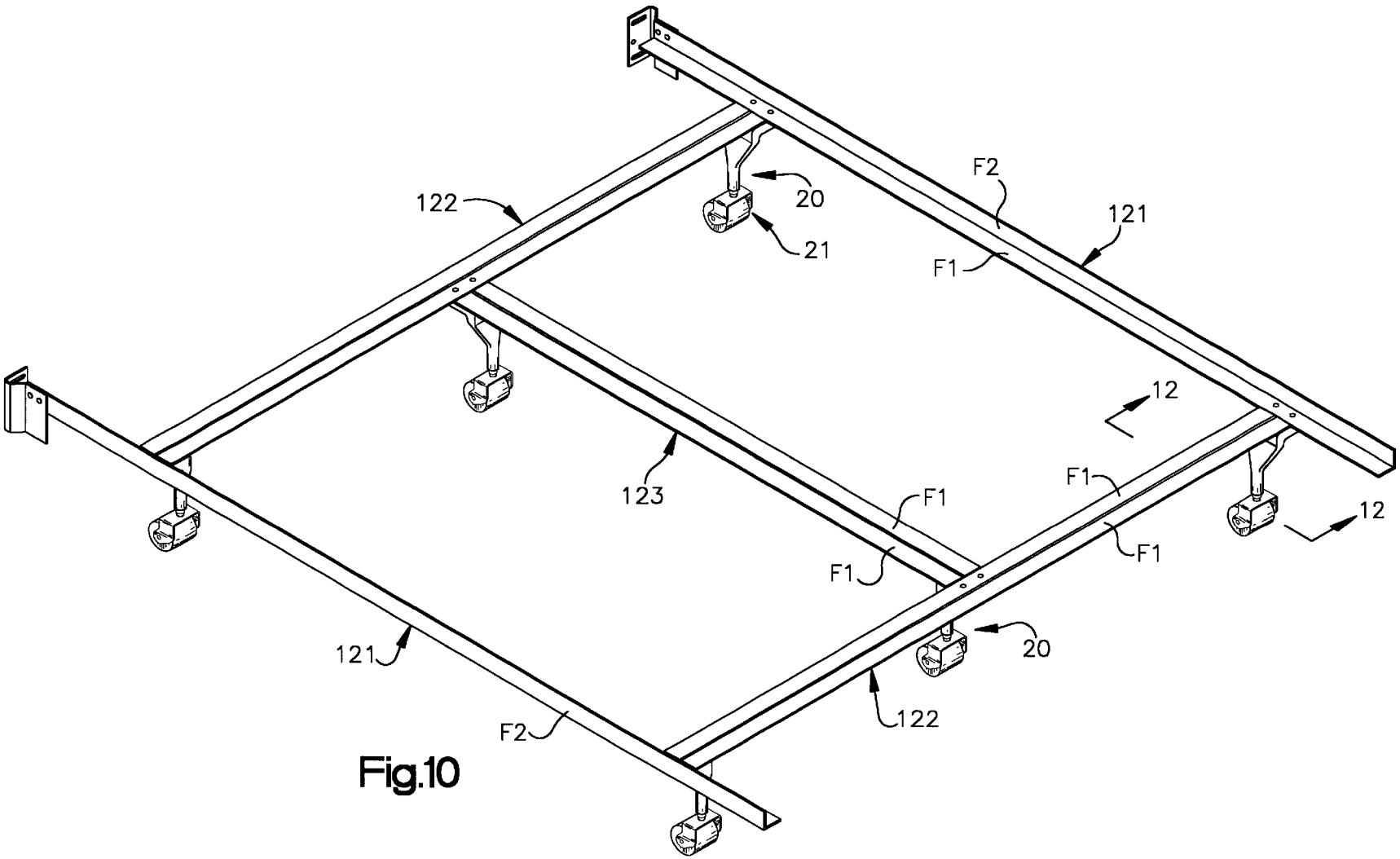
FIG. 10 is a perspective view of an alternate embodiment of a bed frame of the present invention.
Figure 11:
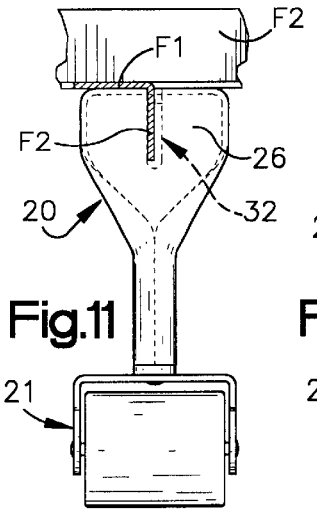
FIGS. 11–13 are elevations of a caster mount and rail intersection area of a bed frame of the invention.

As shown for example in FIG. 3, the depth of notch 33 is dimensioned to position the surface of flange F1 of rails 122 flush with the surface of flange F1 of rails 121. Similarly, as shown in FIGS. 1 and 10, at the intersection of the center rails 123 with the transverse rail 122, the top surfaces F1 of the center rails 123 are flush with the surface of flange F1 of transverse rail 122. This is a significant improvement over prior art bed frame designs wherein wedge-engaged brackets which connect to form the rail intersections leave the supporting flange of the transverse or cross rail at an elevation above or below that of the intersecting side rail. The flush support frame of the invention provides a truly flush support surface with all of the flanges F1 in the same plane.

Figure 9:
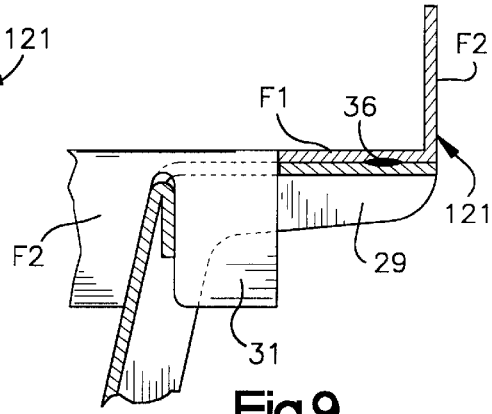
FIG. 9 is an elevation of an intersection area of a bed frame of the present invention.

As shown in FIG. 2, the remaining area of the top wall 28 not traversed by slot 32 provides a contact support and attachment surface for flange F1 of rails 121. Rails 121 are fastened to the top wall 28 of caster mounts 20 by any suitable fastener means such as rivets 37, carriage bolts and nuts, or resistance welds 36. As shown in FIGS. 3 and 9, resistance welds 36 is preferred for the reason that they create no protrubence on the top supporting surface of flange F1 of rail 121, which would contact the box spring frame.

Figure 13:
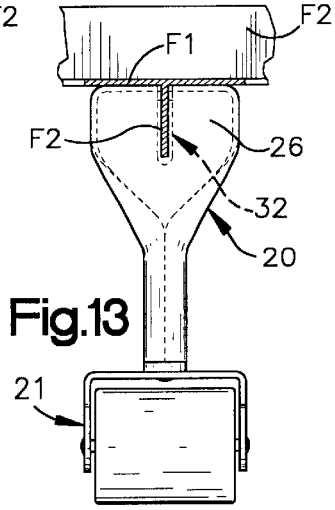

As shown in FIG. 1, at the intersection of the transverse rails 122 and center rails 123, because there are two side-by-side center rails 123 with adjacent flanges F2 both fitting into notch 33, and the top surfaces of adjacent flanges F1 of rails 123 are flush and in the same plane with the top surface of flange F1 of transverse rail 122. The top wall 28 of caster mount 20 is similarly fastened to flange F1 of rail 122, and flange F2 extends downward generally opposite to the caster side wall 26. The center rails 123 may alternatively be constructed as a single rail member with the T-shaped cross section shown in FIG. 13. Or, the abutting center rails 123 can be riveted or resistance welded together through flanges F2, to avoid any confusion with the transverse rails 122 during assembly.

Figure 6:
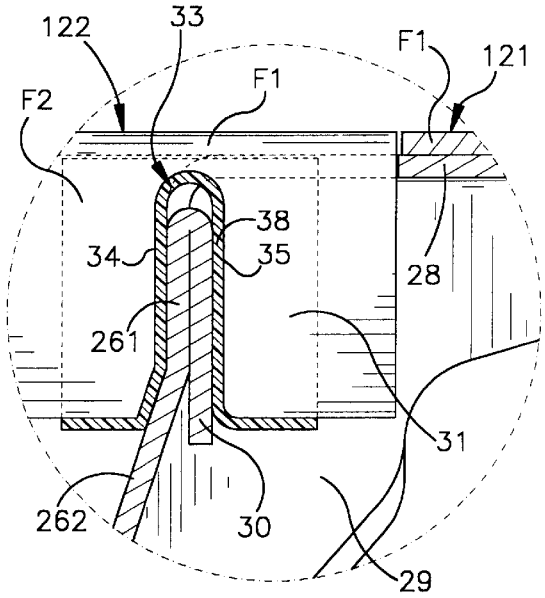
FIG. 6 is an elevation of an intersection portion of an alternate embodiment of a bed frame structure of the present invention.

FIG. 6 illustrates an alternate embodiment of the invention wherein an intermediary material 38 is provided about the perimeter of notch 33 in the intersecting rail 122, for direct contact with upper section 261 of side wall 26 and with tab 30. The material 38 may be, for example, a plastic or rubber material molded to conform to the contact edges 34 and 35 of notch 33 and dimensioned to provide a tight fit over the caster mount side wall 26 and tab 30. Elasticity of the material 38 creates a live engineered joint between the rail 122 and the caster mount 20 which responds to varying loads upon the frame, and which is silent under operative dynamic loading.

Figure 12:
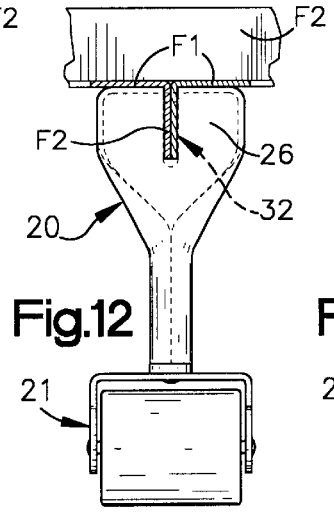

FIG. 10 illustrates a bed frame 10 wherein two adjacent transverse rails 122 are provided at each end of the center rails 123, with flanges F2 abutting, and flanges F1 flush in the same plane. The flanges F2 of the transverse rails 122 are both engaged in slot 32 as shown in FIG. 12. This embodiment of frame 10 is suitable for commercial, institutional or other heavier duty applications where a larger support area, as provided by the co-planar flanges F1, is desired.

Figure 14:
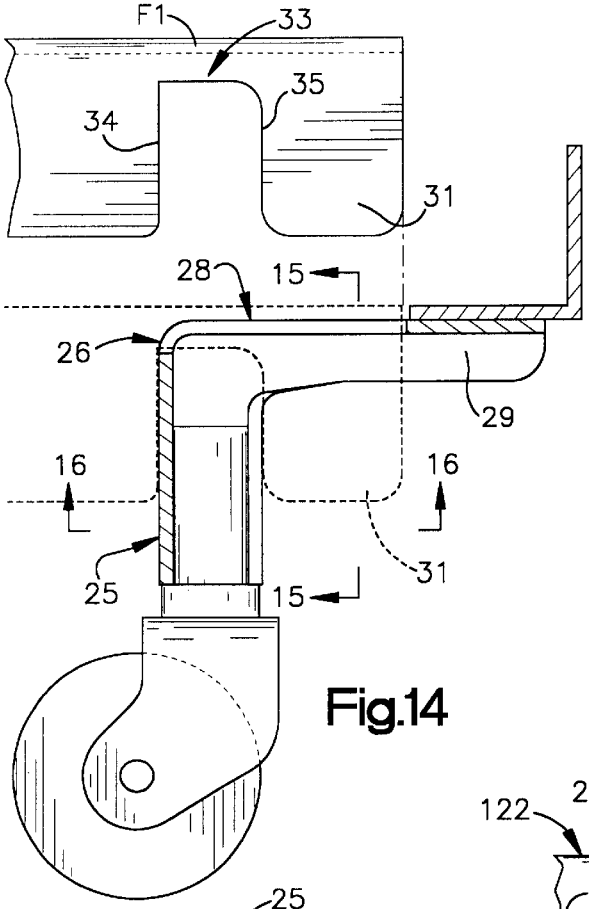
FIG. 14 is an elevation of an alternate embodiment of a caster mount of the present invention and the interlocking portion of a rail member.
Figure 15:
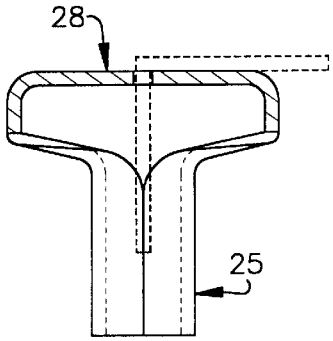
FIG. 15 is an elevation of a portion of the caster mount of FIG. 14, in the direction of the arrows 15—15.
Figure 16:
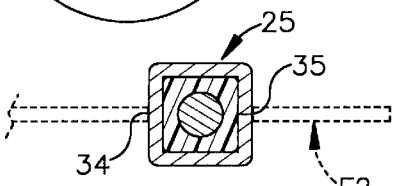
FIG. 16 is a cross-sectional view of the caster mount of FIG. 14.

FIGS. 14–16 illustrate a low profile version of the bed frame of the invention, wherein an enlarged notch 33 in flange F2 is dimensioned to fit over the caster shank receiving ferrule 25 of the caster mount 20. The caster mount 20 is modified to an extent to minimize or eliminate side wall 26, to thereby significantly reduce the total vertical height of the caster mount and caster, thereby lowering the entire frame. This is desirable for use with mattresses and box springs of greater thickness or vertical extent, or simply to reduce the height of any bed set. The slot 32 is similarly formed in the top wall 28, and a remaining portion of the top wall is provided for attachment of the side rail 121. The caster shank receiving ferrule 25 can be similarly roll-formed but, as shown in FIG. 16, is preferably box roll-formed to provide positive registration of the contact edges 34 and 35 of notch 33. In such case the bushing for the caster shank can be made with a square cross-section. Leg 31 is located beneath top wall 28 and adjacent to caster shank receiving ferrule 25.

Figure 18A:
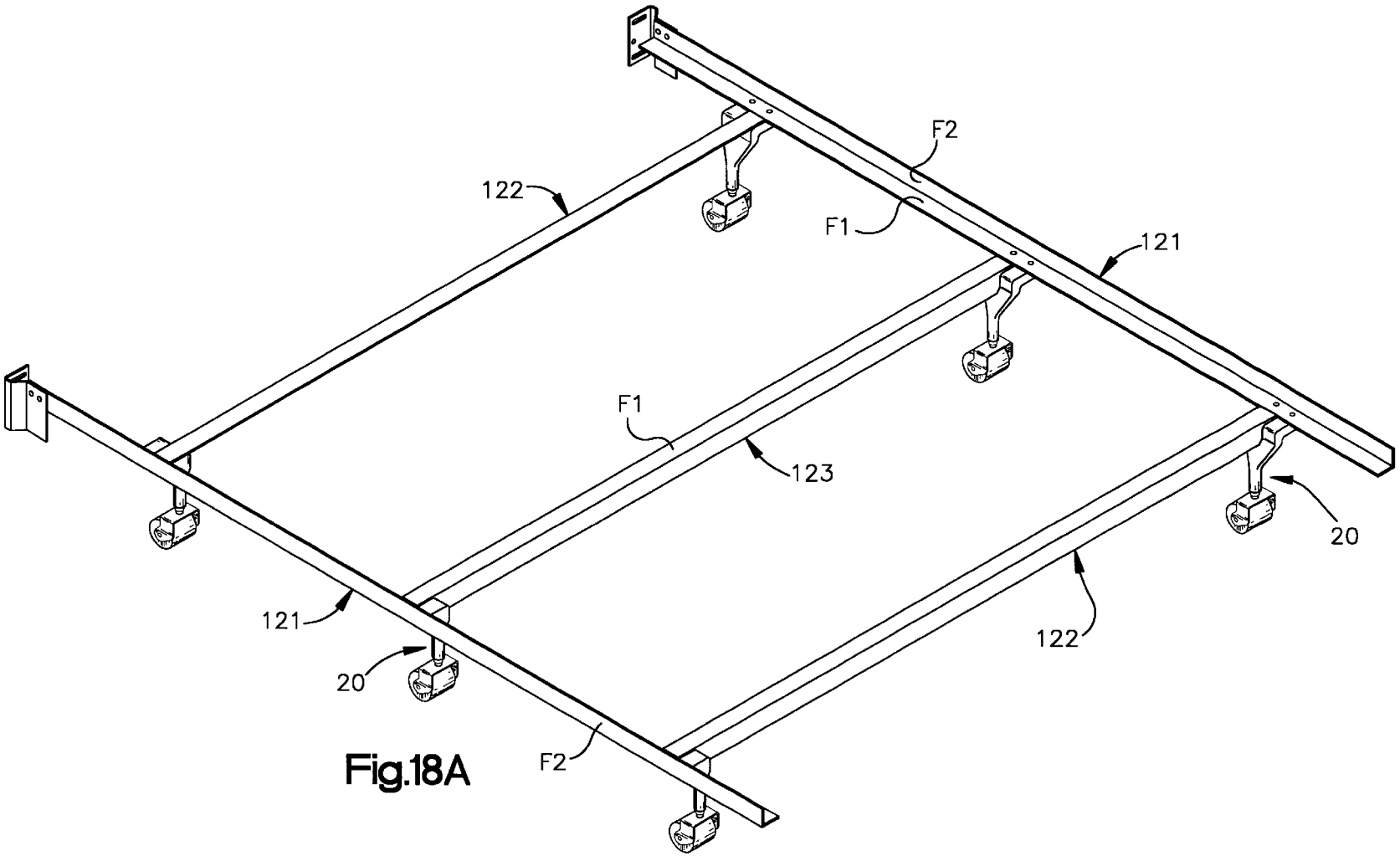
FIGS. 18A and 18B are perspective views of alternate embodiments of a bed frame of the present invention.
Figure 18B:
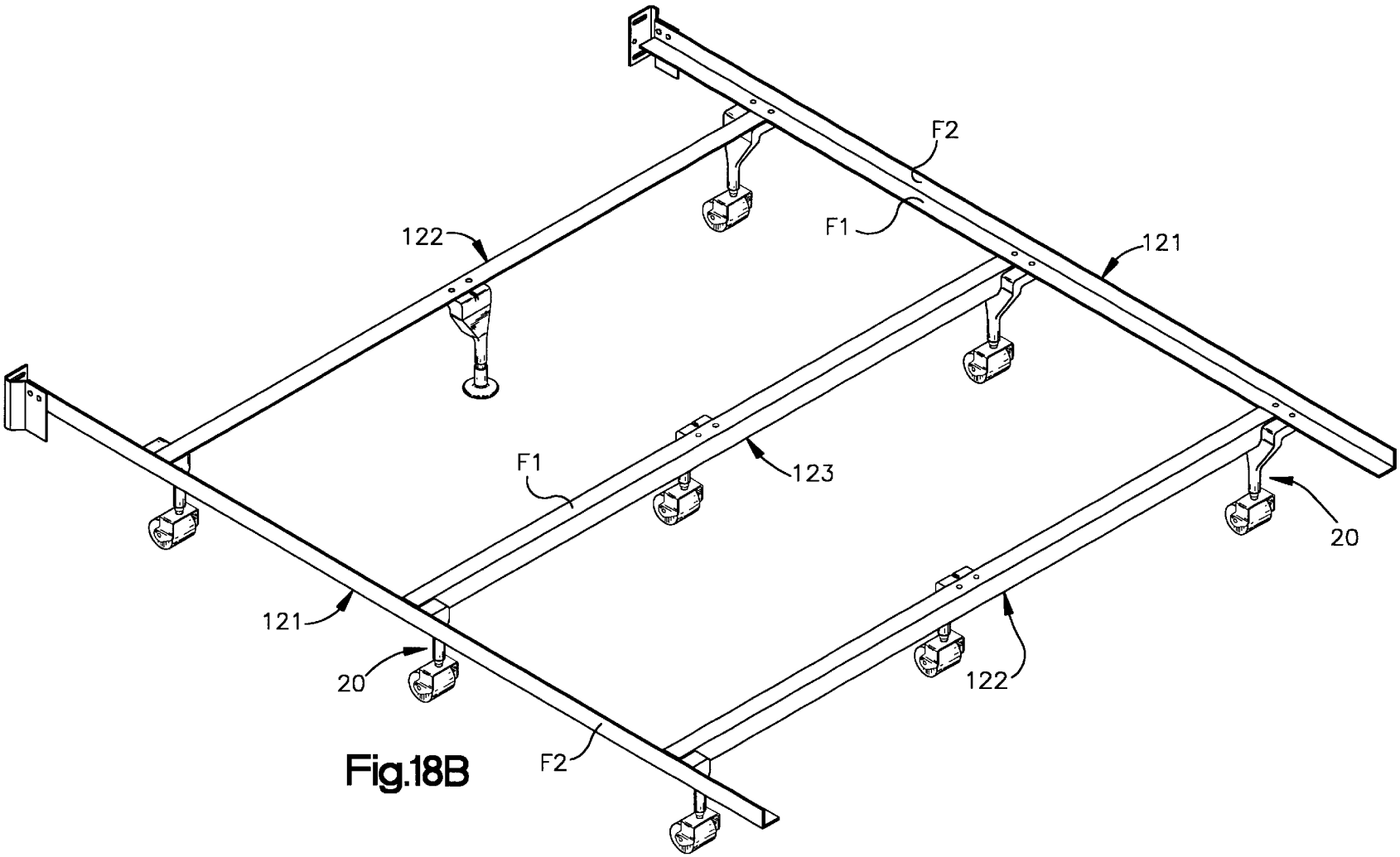

FIG. 18A illustrates still another embodiment of the bed frame of the invention wherein the center rail 123 is oriented to extend between the side rails 121, and parallel to the transverse rails 122, i.e., ninety degrees to the orientation of FIG. 1. In this embodiment, the intermediate caster mounts 20 are attached to the side rails 121 between the caster mounts at the ends of the transverse rails 122. This embodiment may be preferred in certain installations to prevent sagging of a box spring between the side rails 121, as for example with king size mattresses supported by two twin foundations. As shown in FIG. 18B, one or more additional caster mounts 20 can be placed in the middle of the center rail 123 or at any intermediate points in any of the rails, in connection with casters 21 or fixed supports or glides 211, for added support. The transverse rails 122 and center rail 123 can also be made in the T-shaped cross section as previously described and shown in FIGS. 12 and 13.

Although the invention has been shown and described with reference to certain preferred and alternate embodiment, it will be appreciated that other variations could be made to the various designs which are within the concept and scope of the invention, including the basic principles of using the terminal ends of the rails as interlocking members at the intersections without the use of bracketry attached to the rails, and providing a universal caster mount. For example, although described with reference to the terminal ends of the transverse rails interlocking with the caster mounts which are attached to the side rails, the invention could be similarly and equivalently implemented by attaching the caster mounts to the transverse rails and having terminal ends of the side rails interlock with the caster mounts.

What is claimed is:

1. A bed frame assembly comprising:

rail members interconnected to form a generally orthogonal frame structure, each rail member having at least one flange oriented in a horizontal plane, the rail members including laterally opposed and spaced apart side rails, and opposed spaced apart transverse rails which extend generally perpendicularly between the side rails, with ends of the transverse rails positioned proximate to the side rails, a caster mount located at each end of the transverse rails, each caster mount having a main body, a top wall, a side wall, and a caster shank receiving ferrule, the top wall of each caster mount fastened to a side rail proximate to the ends of the transverse rails, and a rail receiving slot in the caster mount, wherein the rail receiving slot in the caster mount is in the top wall of the caster mount formed by a tab cut from the top wall of the caster mount and positioned parallel to the side wall of the caster mount, and extends generally to a point of intersection of the top wall and the side wall and ends of the transverse rails having a notch and an end section proximate to the notch, the end section adapted to fit in the slot in the caster mount, and the notch adapted to fit over the side wall and tab of the caster mount.

2. The bed frame of claim 1 in which the caster mounts are of a unibody construction.

3. The bed frame of claim 1 wherein the transverse rails have a generally vertically oriented flange wherein the notch is located.

4. The bed frame of claim 1 wherein a horizontal flange of the transverse rails is in the same plane as the horizontal flange of the side rails.

5. The bed frame of claim 1 wherein the notch in the transverse rail extends substantially the width of the vertical flange of the transverse rail.

6. The bed frame of claim 1 in which the slot in the caster mount has a length which extends across a portion of the top wall of the caster mount, and a width sufficient to receive a cross-sectional thickness of one or two flanges of the rails.

7. The bed frame of claim 1 further comprising a center rail which extends between the transverse rails, and wherein each of the ends of the center rail are engaged in a caster mount attached to the transverse rails.

8. The bed frame of claim 1 wherein at least one of the transverse rails has a generally T-shaped cross-section with at least one flange disposed generally vertically within the slot in the caster mount.

9. A single piece bed frame caster mount for intersecting flush surface connection of at least two rails of a bed frame, and for generally vertical mounting of a caster, the caster mount comprising:

a body having a generally horizontal top wall and dimensioned for attachment to an underside of a first rail of a bed, a side wall connected to and extending generally downward from the top wall, and a caster shank receiving ferrule connected to the side wall, a slot formed in the top wall by a tab cut from the top wall and positioned parallel to the side wall, whereby the slot is adapted to receive a portion of a second rail of a bed frame through the top wall and proximate to the side wall, and another portion of the second rail on top of the top wall ad substantially flush with the portion of the first rail on the top wall of the caster mount.

10. The caster mount of claim 9 wherein the side wall has an upper section and a lower section, and the upper section is angled relative to the top wall at a first angle, and the lower section is angled relative to the top wall at a second angle.

11. The caster mount of claim 9 further comprising generally parallel flanges which extend from lateral edges of the top wall and the side wall.

12. The caster mount of claim 9 wherein the slot extends across a portion of the top wall, and a remaining portion of the top wall is provided for attachment of a rail of a bed frame.

13. The caster mount of claim 9 wherein the caster shank receiving ferrule has a substantially square cross-sectional configuration.

14. A bed frame having two spaced apart side rails and two spaced apart transverse rails, the transverse rails being generally perpendicular to the side rails, ends of the transverse rails positioned proximate to the side rails, a single piece universal caster mount attached to the side rails proximate to each of the ends of the transverse rails, the single piece universal caster mounts each having a generally horizontal top wall, a side wall which extends generally downward from the top wall, and a caster shank receiving ferrule which extends from the side wall, the top wall configured for attachment to an underside portion of a side rail, and a slot in another portion of the top wall adapted to receive a portion of an end of a transverse rail, and a portion of the transverse rail positioned in overlying contact upon the top wall of the caster mount and substantially flush with the portion of the side rail on the top wall of the caster mount.

15. The bed frame of claim 14 wherein the rails are generally L-shaped in cross-section, each rail having a first flange F1 and a second flange F2, and wherein the second flange F2 of the transverse rails is generally vertically oriented when engaged with the caster mounts, and further including a notch in the second flange F2 at the ends of the transverse rails, the notch configured to engage with the slot in the caster mount.

16. A bed frame comprising rail members interconnected by caster mounts to form a frame structure supported by casters attached to the caster mounts, the caster mounts having a top wall upon which first rails are attached in a first orientation, the top wall connected to a side wall and a caster shank receiving ferrule, and a centrally located slot in the top wall for receiving an end of a second rail defined by a notch in a single flange of the second rail, wherein the notch fits over a top edge of the side wall proximate to an intersection of the side wall and the top wall, the cross-sectional configuration of the end of the second rail attached to the caster mount being the same as the cross-sectional configuration of the rest of the second rail.

17. A low profile caster mount for use in connection with a bed frame having rail members interconnected by a plurality of caster mounts to form a bed frame with a low elevation, the low profile caster mount comprising:

a body formed of a single piece having a top wall, and a caster shank receiving ferrule connected to the top wall and extending generally perpendicular from the top wall, a portion of the top wall configured for attachment of a rail of a bed frame flush against the top wall, and a slot in an adjacent portion of the top wall, the slot located generally above the caster shank receiving ferrule and configured to receive a leg portion of an end of a single flange of a rail engaged with the caster mount through the slot, the end of the single flange of the rail having a notch configured to fit over a portion of the caster shank receiving ferrule and another flange of the rail engaged in the slot in the caster mount resting on the top wall of the caster mount.

18. The low profile caster mount of claim 17 wherein the caster shank receiving ferrule has a generally square cross-sectional configuration.

19. A bed frame having intersecting rails connected by universal caster mounts, each of the rails having a first flange F1 oriented to provide a support surface for a mattress box spring, and second flange F2, a universal cast mount attached to the rails at points of intersection with intersecting rails, a notch in the second flange F2 at the terminal ends of the intersecting rails and a leg in the second flange F2 proximate to the notch, the notch configured to fit over a top edge of a side wall of the universal caster mount, and the leg configured to fit through a centrally located slot in a top wall of Me universal caster mount, the slot extending from an edge of a first flange F1 in contact with the top wall of the universal caster mount to an intersection of the top wall with the side wall.

20. A system for securing intersecting support rails of a bed frame comprising:

a side support rail member having a first flange generally located in a horizontal plane, a caster mount attached to the underside of the horizontal flange of the side support rail member, the caster mount being of unibody construction, with a top wall, a receiving slot in the top wall for receiving a transverse support rail, a bottom portion consisting of a caster shank receiving ferrule for receiving a support caster, and a bridge portion integrally spanning between the top wall and the bottom portion, a transverse support rail with a first flange in the horizontal plane and a second flange in a vertical plane, a notch in the second flange configured engage the receiving slot in the top wall of the caster mount such that the first flange of the transverse support rail and the first flange of the side support rail member lie in the same horizontal plane and are closely adjacent upon the top wall of the caster mount, and a portion of the first flange of the transverse support rail is in overlying contact with the top wall of the caster mount.

21. A bed frame assembly providing a support structure for a box spring and mattress the bed frame assembly comprising:

side rail support members oriented generally parallel and spaced apart, transverse rail support members generally parallel and orthogonal to the side rail support members, and unibody caster mounts attached to the side rail members, with the caster mounts comprising a top wall for supporting the side and transverse rail support members, a bottom portion with a caster shank receiving ferrule, a bridge portion spanning from the top wall to the receiving ferrule, and a centrally located slot in the top wall, the slot in the top wall oriented generally perpendicular to the side rail support members, and dimensioned to receive terminal ends of the transverse rail support members, the longitudinal dimension of the slot spanning from an edge of the side rail support member to an intersection of the bridge portion with the top wall, and width of the slot being approximately the width of the transverse rail support member to be received.

22. A caster mount of unibody construction with a top wall, a bottom portion with a caster shank receiving ferrule, and a bridge portion spanning from the top wall to the receiving ferrule, the top wall comprising a first surface attached to an underside of a side rail of a bed frame for supporting the side rail, a second adjacent surface for supporting a flange of a transverse rail of a bed frame adjacent to and flush with a portion of the side rail, and a centrally located slot in the second surface for receiving a terminal end of the transverse rail, the slot in the second surface oriented generally perpendicular to an edge of the side rail and extending to the bridge portion.

* * * * *